United States Patent [19]

Ceurvorst

[11] Patent Number: 4,519,551

[45] Date of Patent: May 28, 1985

[54] REPLACEABLE PROTECTIVE CAPS FOR SPIDER ARMS OF A REVERSIBLE HAMMER MILL

[75] Inventor: Kenneth Ceurvorst, LeClaire, Iowa

[73] Assignee: Sivyer Steel Corporation, Bettendorf, Iowa

[21] Appl. No.: 501,839

[22] Filed: Jun. 7, 1983

[51] Int. Cl.[3] ..... B02C 13/26

[52] U.S. Cl. ..... 241/194; 241/197

[58] Field of Search ..... 241/191-194, 241/197, 189 A, 189 R, 300

[56] References Cited

U.S. PATENT DOCUMENTS

| | | | |
|---|---|---|---|
| 3,727,848 | 4/1973 | Francis | 241/194 |
| 3,829,032 | 8/1974 | Schrimper | 241/197 |
| 3,838,826 | 10/1974 | Wallace et al. | 241/197 |
| 3,844,494 | 10/1974 | Hightower | 241/197 |
| 4,000,859 | 1/1977 | Whitney | 241/194 |
| 4,049,202 | 9/1977 | Schmidt | 241/30 |
| 4,056,232 | 11/1977 | Linnerz et al. | 241/194 |
| 4,117,985 | 10/1978 | Lazareck | 241/197 |
| 4,136,833 | 1/1979 | Knight | 241/194 |
| 4,202,504 | 5/1980 | Cameron | 241/194 |
| 4,222,530 | 9/1980 | Whitney | 241/194 |
| 4,313,575 | 2/1982 | Stepanek | 241/194 |
| 4,352,774 | 10/1982 | Hornberger | 264/263 |

*Primary Examiner*—Mark Rosenbaum

*Attorney, Agent, or Firm*—Quarles & Brady

[57] ABSTRACT

The tip of a spider arm of a rotor of a reversible hammer mill is protected from wear and damage by a pair of replaceable caps. Each of the caps has a protective shroud for protecting a portion of the extremity of the tip and an adjacent edge of the spider arm. The caps also each have a relatively narrow web which is sized to fit within and cooperate with the web of another cap in substantially filling an open-ended slot in the spider arm. The webs of the two caps are introduced into the slot from opposite ends of the slot and held in place by a hammer pin which extends through collinear openings in the webs and the spider arm.

3 Claims, 7 Drawing Figures

REPLACEABLE PROTECTIVE CAPS FOR SPIDER ARMS OF A REVERSIBLE HAMMER MILL

FIELD OF THE INVENTION

The invention relates to hammer mills. More particularly, it relates to replaceable protective caps for the spider arms of a reversible hammer mill.

DESCRIPTION OF THE PRIOR ART

Hammer mills are used to break up or shred a wide variety of materials, including scrap metal and garbage. Among the more popular designs of hammer mills is one which consists of a rotary hammer assembly having a series of axially adjacent spiders mounted on a shaft which has its end portions journalled in bearings in the opposite side walls of the mill. Between and mounted on the outer end portions of the spider arms of this design hammer mill there are freely swinging hammers that coact with stationary comb teeth and grate bars spaced circumferentially around part of the orbit of the hammers to fragmentize whatever is fed into the mill.

In the course of fragmenting the feed material in the described hammer mill, the tips or end portions of the spider arms, as well as the hammers, are subjected to severe wear. The worn surfaces of the spider arms must be restored or else the mill loses effectiveness and the connections between the spider arms and the hammers can become dangerously weakened. The restoration may be accomplished by sputtering steel onto the worn surfaces. However, building up the worn spider arm tips in this manner is a time-consuming and laborious job which can lead to substantial down time.

In the Francis U.S. Pat. No. 3,727,848 issued Apr. 17, 1973, a replaceable cap is disclosed for protecting the leading edge of a tip of a spider arm of a hammer mill from excessive wear. The cap of the Francis patent is a significant improvement over previous practices for protecting the tips of the spider arms and works well with a hammer mill that is rotated in only one direction. However, the Francis cap provides no protection when the direction of rotation of the hammer mill is reversed.

SUMMARY OF THE PRESENT INVENTION

It is an object of the present invention to provide a pair of readily replaceable caps to protect the entire tip, including both adjacent edges, of the spider arm of a reversible hammer mill and to disclose a method of attaching the caps to the arm which keeps them securely in place and yet permits them to be readily removed when they have to be replaced.

It is a still further object to disclose a reversible rotor with a spider arm that is particularly adapted to receive a pair of protective caps.

Each of the protective caps of the present invention has a main body having a generally crescent-shaped protective shroud which is intended to protect a portion of the extremity of the tip and an adjacent edge of the spider arm. Projecting inwardly from the inner face of the shroud is a relatively narrow web which is adapted to enter one end of an open ended slot in the tip of the spider arm. The web cooperates with the complementary web of another cap inserted into the other end of the slot to substantially fill the slot and a hammer pin is used to lock both of the caps in place with the shrouds protecting the extremity and both adjacent edges of the spider arm. Preferably, anti-rotation means on the caps and the slot prevent the caps from being moved by the centrifugal force as the rotar rotates. The caps are preferably identical and cast of a specially hardened, more wear resistant material than the spider arm.

The means of achieving the foregoing and further objects by means of the present invention will be apparent to those skilled in the art from the description and drawings which follow:

BRIEF DESCRIPTION OF THE DRAWINGS

The accompanying drawings illustrate a preferred embodiment of the invention in which.

DESCRIPTION OF THE PREFERRED EMBODIMENT

Figure 1:
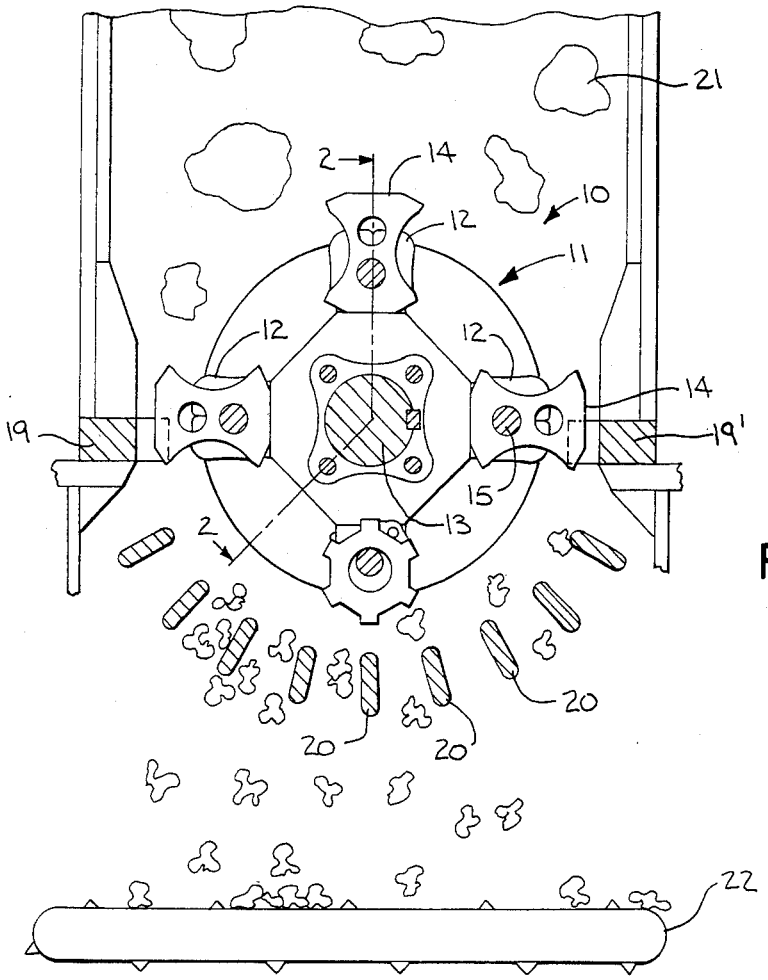
FIG. 1 is a vertical sectional view through a hammer mill embodying this invention.

Referring to FIG. 1 of the drawings, the numeral 10 designates generally the fragmentizing chamber of a hammer mill which has a rotary hammer assembly 11 mounted therein. The hammer assembly 11 comprises a series of four-armed spiders 12 mounted on and keyed to a shaft 13 which is journalled in bearings (not shown) that are structurally supported in the side walls of the mill. As seen best in FIG. 2, hammers 14 are mounted on a hammer pin 15 which extends through aligned openings in the hammer and the ends of adjacent spider arms **12*a* so that the hammers 14** can swing freely.

Figure 3:
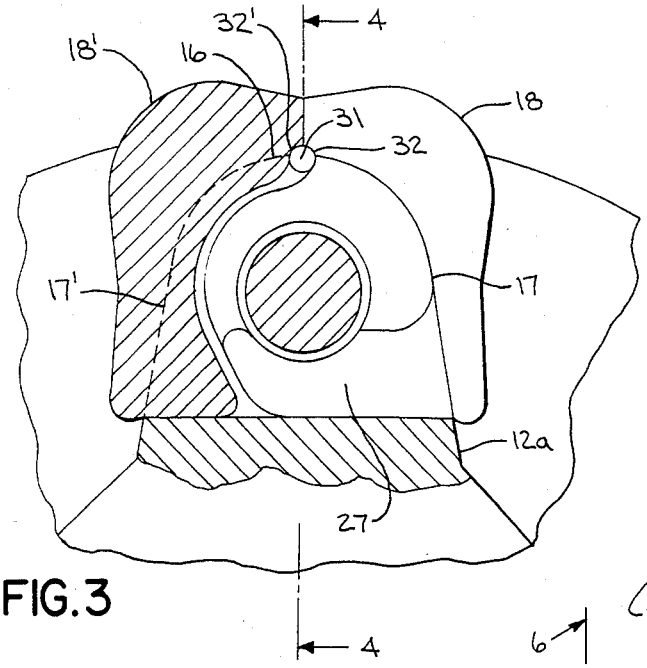
FIG. 3 is an enlarged view, partially in section, of an end portion of one of the spider arms, with the protective caps of the invention applied thereto.
Figure 6:
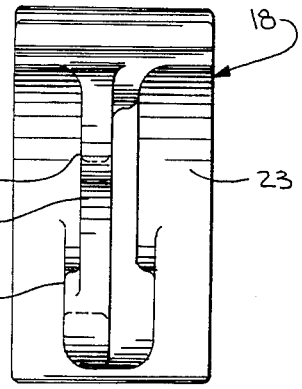
FIG. 6 is an end view of the cap of FIG. 5 taken along line 6—6 in FIG. 5.

Referring to FIG. 3, it can be seen that the outer extremity of the tip 16 and the adjacent leading edges 17, 17' of the spider arm **12*a* are protected by a pair of replaceable caps 18, 18'**.

Returning to FIG. 1, it can be seen that when the hammer assembly 11 is rotated counterclockwise, the hammers 14 coact with the top side of teeth of a rigidly mounted cutting comb 19 that extends lengthwise of the hammer assembly and with grate bars 20, that are circumferentially spaced around part of the orbit of the hammers, to break up any material entering the mill through the open top 21. When the hammer assembly 11 is rotated clockwise in the opposite direction, the hammers 14 cooperate with the grate bars 20 and the teeth of a second cutting comb 19' to break up large pieces of the feed material which are within the fragmentizing chamber 10. The pieces or fragments when small enough fall through the spaces between the grate bars 20 and onto a delivery conveyor 22 which carries them out of the mill. The mill shown is only one of several designs of hammer mills in which the present invention may be employed.

Figure 4:
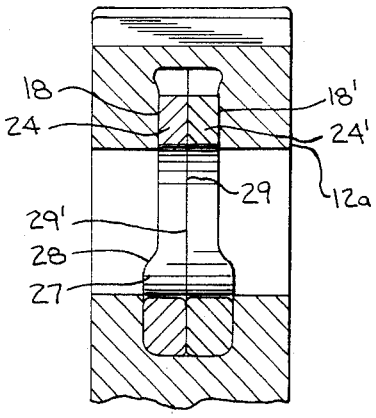
FIG. 4 is a sectional view taken along line 4—4 of FIG. 3.
Figure 7:
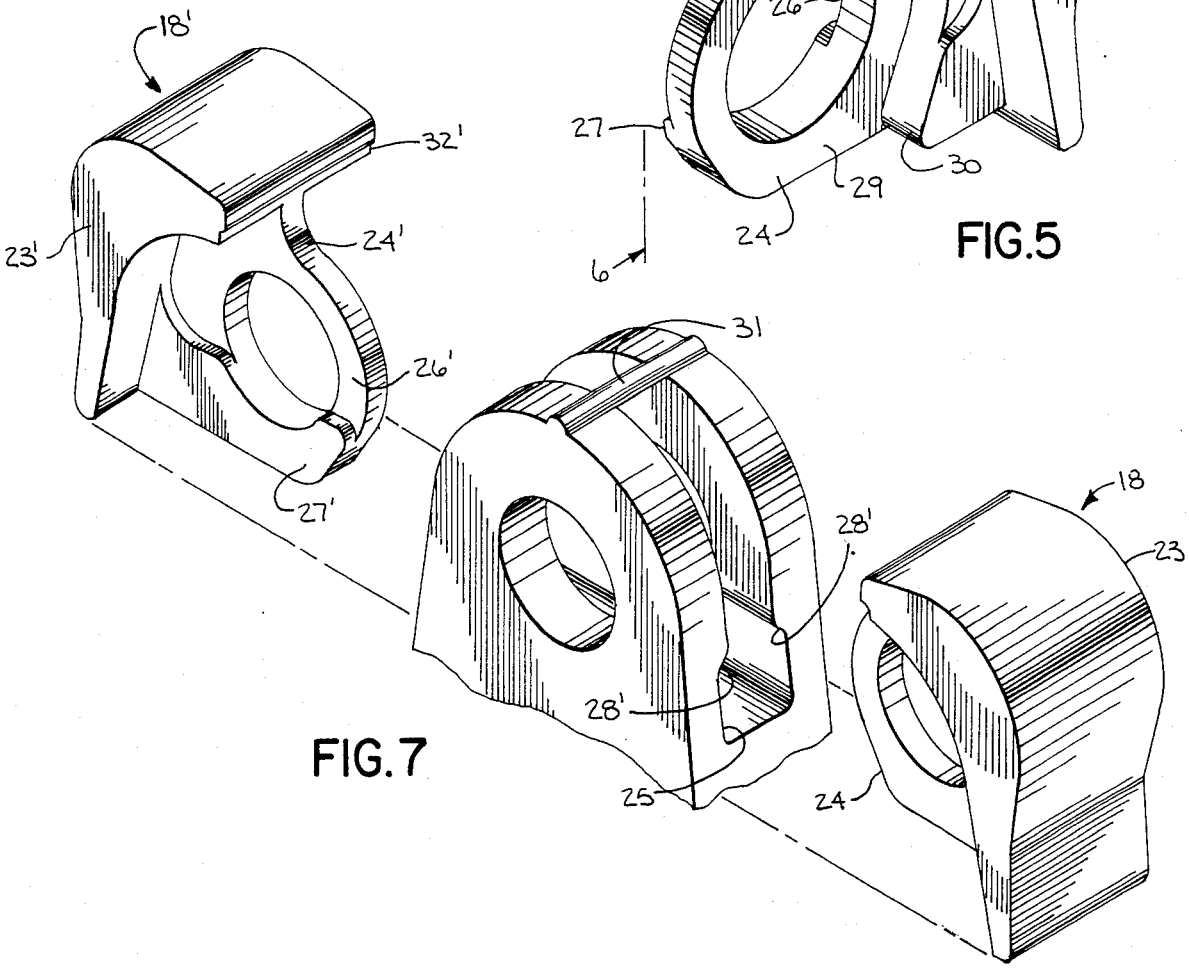
FIG. 7 is a perspective view of the end portion of a spider arm and the pair of the caps of FIG. 5, showing the same disassembled.

The manner in which a pair of caps 18, 18' cooperate to protect the entire tip 16 of the arm **12*a* including the outer extremity and the leading edges 17, 17' of the spider arm 12*a* can be seen in FIGS. 3, 4 and 7**.

Turning now to FIGS. 3 to 7, it can be seen that the cap 18, which is identical to cap 18', has a main body that includes a crescent-shaped shroud portion 23 which is shaped to fit over one-half of the tip 16 of the spider arm 12*a* including an adjacent edge 17. The cap 18 also includes a web 24 that projects inwardly from the inner surface of the crescent-shaped shroud 23 and is adapted to fit into one end of an open-ended, inverted T-shaped slot 25 (seen best in FIG. 7) of the spider arm 12*a*.

One face 26 of the web of the cap 18 is provided with an abutment 27 which cooperates with a shoulder 28 in the slot 25 to prevent the cap 18 from rotating (as seen in FIG. 4). The other face 29 of the web 24 has an abutment 30 which helps to fill the void in the slot 25 which would otherwise exist when a pair of caps are properly in position. Both the slot 25 and the web 24 are symmetrically located with respect to the thickness of the spider arm 12*a* and the width of the cap 18. In addition, the width of the shroud 23 is the same as the thickness of the spider arm 12*a* and the side edges of the shroud 23 are shaped to be flush with the axially opposite faces of the spider arm 12*a*.

As seen best in FIGS. 4 to 7, the faces 29, 29' of the webs 24, 24' of the caps 18, 18' are complementary. In the preferred embodiment shown they are flat but other complementary shapes could be used.

Figure 2:
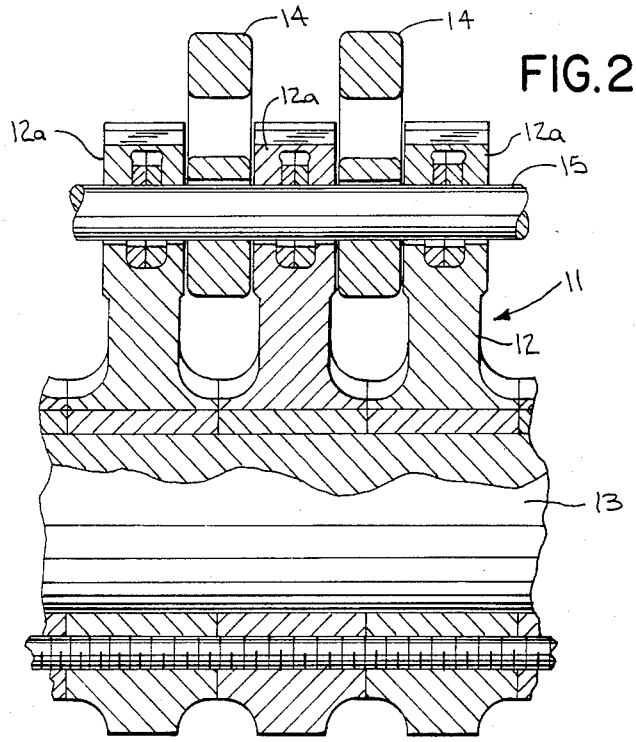
FIG. 2 is a perspective view of a portion of the hammer assembly of the mill.
Figure 5:
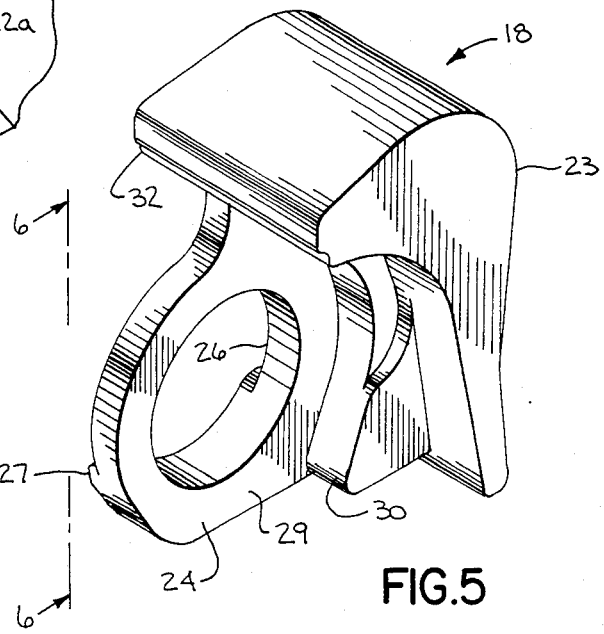
FIG. 5 is a perspective view of the preferred embodiment of the protective cap.

Referring to FIG. 5, it can be seen that the slot 25 is open at the top except for a bridge 31. When the caps 18, 18' are in place, as seen in FIG. 3., the bridge 31 is received in grooves 32, 32' in the top of the caps 18, 18' and thus protected from injury. The caps 18, 18' once properly positioned in the slot 25 are locked in place by the hammer pin 15, as seen in FIG. 2, which extends through collinear openings in the caps 18, 18' and the spider arm 12*a*.

The principal function of the caps 18, 18' is to protect the extremity of the spider arm 12*a* from wear but the caps also do come in contact with the material being shredded and help to break it into smaller pieces. As a result, the caps become worn and eventually need to be replaced like the hammers 14. When a cap is worn down to a predetermined level, it is replaced by a new cap in the following manner. The hammer pin 15 is withdrawn at least sufficiently to permit the caps 18, 18' to be withdrawn from the slot 25. The new caps are then inserted, one from each side as shown in FIG. 7, and the pin 15 reinserted through the aligned openings in the caps and slot sidewalls. To assist in handling the cap which can be quite heavy, it may be provided with an opening (not shown) to receive a lift hook.

From the foregoing description, one skilled in the art can easily ascertain the essential characteristics of this invention, and without departing from the spirit and scope thereof, can make various changes and modifications of the invention to adapt it to various usages and conditions. For example, although in the preferred embodiment the caps are identical, they could be different in external shape as long as the webs are complementary. Consequently, such changes and modifications are intended to be, covered by the following claims.

I claim:

1. For use in a reversible hammer mill including a rotor with a spider arm, replaceable cap members for protecting the tip of a spider arm comprising:

(a) a pair of cap members;

(b) each cap member defining a body having an outer protective shroud for protecting a portion of said tip of said spider arm; and (c) a relatively narrow web projecting inwardly from an interface of the shroud of each said cap, each said web sized to interfit with each other in an opposing manner within an open-ended slot in the spider arm; each said web including a pin receiving opening for cooperating with aligned openings in the spider arm to secure each said cap to the spider arm.

2. The replaceable cap members of claim 1 in which the webs have antirotation means on the webs which cooperate with mating antirotation means in the slot to prevent the cap from moving as the rotor rotates.

3. The replaceable cap members of claim 2 in which the antirotation means is an abutment on the webs.

* * * * *